US009082392B2

(12) United States Patent
Murthy et al.

(10) Patent No.: US 9,082,392 B2
(45) Date of Patent: Jul. 14, 2015

(54) METHOD AND APPARATUS FOR A CONFIGURABLE ACTIVE NOISE CANCELLER

(71) Applicant: Texas Instruments Incorporated, Dallas, TX (US)

(72) Inventors: Nitish Krishna Murthy, Allen, TX (US); Supriyo Palit, Kolkata (IN); Edwin Randolph Cole, Dallas, TX (US); Jorge Francisco Arbona Miskimen, Dallas, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 310 days.

(21) Appl. No.: 13/655,060

(22) Filed: Oct. 18, 2012

(65) Prior Publication Data

US 2014/0112491 A1 Apr. 24, 2014

(51) Int. Cl.
*G10K 11/178* (2006.01)

(52) U.S. Cl.
CPC .... *G10K 11/1788* (2013.01); *G10K 2210/1081* (2013.01); *G10K 2210/3028* (2013.01); *G10K 2210/3033* (2013.01); *G10K 2210/3214* (2013.01)

(58) Field of Classification Search
None
See application file for complete search history.

(56) References Cited

U.S. PATENT DOCUMENTS

| | | | | |
|---|---|---|---|---|
| 2008/0107282 | A1* | 5/2008 | Asada | 381/71.14 |
| 2012/0057720 | A1* | 3/2012 | Van Leest | 381/71.11 |
| 2013/0243214 | A1* | 9/2013 | Penketh et al. | 381/71.6 |
| 2014/0198925 | A1* | 7/2014 | Alves et al. | 381/71.6 |

* cited by examiner

*Primary Examiner* — Paul Huber
(74) *Attorney, Agent, or Firm* — Mima Abyad; Frank D. Cimino

(57) ABSTRACT

A method and apparatus for active noise canceling. The method includes retrieving an input sample from at least one of a feedback or feedforward microphone digitized through the sigma-delta converter, retrieving the input sample and a related filter, wherein the filter is customized to the particular headset, outputting a filtered signal through a speaker without any interpolation and reducing order of CIC filters, and outputting a response sharply tapered down.

3 Claims, 6 Drawing Sheets

METHOD AND APPARATUS FOR A CONFIGURABLE ACTIVE NOISE CANCELLER

BACKGROUND OF THE INVENTION

1. Field of the Invention

Embodiments of the present invention generally relate to a method and apparatus for a configurable active noise canceller. In one embodiment, the present invention relates to a configurable active noise canceller that may be used in a digital system 2. Description of the Related Art Currently, due to latencies, analogue solutions are used in active noise cancelling devices, such as headsets. Even though such analog solutions tend to have a high bandwidth of noise cancellation, they offer limited tuning of the cancellation profile and music equalization. Furthermore, since music is equalized even when the active noise canceller is OFF, turning off the active noise canceller usually requires either a separate channel for music or turning off the music completely, which is an expensive solution. Hence, the music is usually turned off when the active noise canceller is not active.

Therefore, there is a need for a method and/or apparatus for an improved configurable active noise canceller.

SUMMARY OF THE INVENTION

Embodiments of the present invention relate to a method and apparatus for active noise canceling. The method includes retrieving an input sample from at least one of a feedback or feedforward microphone digitized through the sigma-delta converter, retrieving the input sample and a related filter, wherein the filter is customized to the particular headset, outputting a filtered signal through a speaker without any interpolation and reducing order of CIC filters, and outputting a response sharply tapered down.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
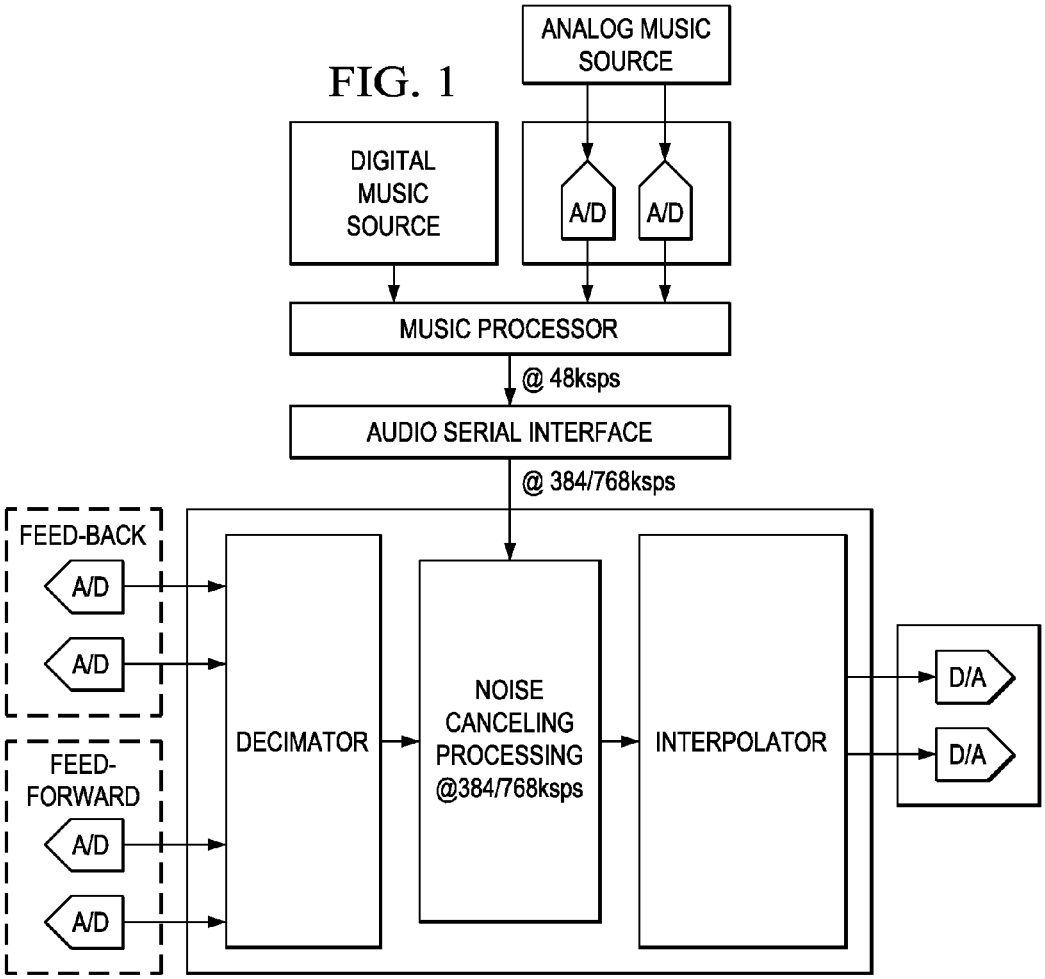
FIG. 1 embodiment depicting a block diagram of an active noise cancellation using a fixed controller at oversampled data rates.

Described herein is a a feedback active noise canceller using a fixed controller at oversampled data rates. FIG. 1 is an embodiment depicting a block diagram of an active noise cancellation using a fixed controller at oversampled data rates. In this embodiment, the active noise canceller comprises analogue to digital converters, a digital signal processor, and digital to analogue converters. The analogue to digital converters convert the left and right internal, i.e feed-back, microphone signals into the digital domain and the left and right external i.e. feed-forward, microphone signals into the digital domain. The digital signal processor is configurable and programmable at sample rates much higher than the typical audio sample rate. The digital to analogue converters convert the noise and audio data into the analog domain and into the headphone speakers.

Figure 2:
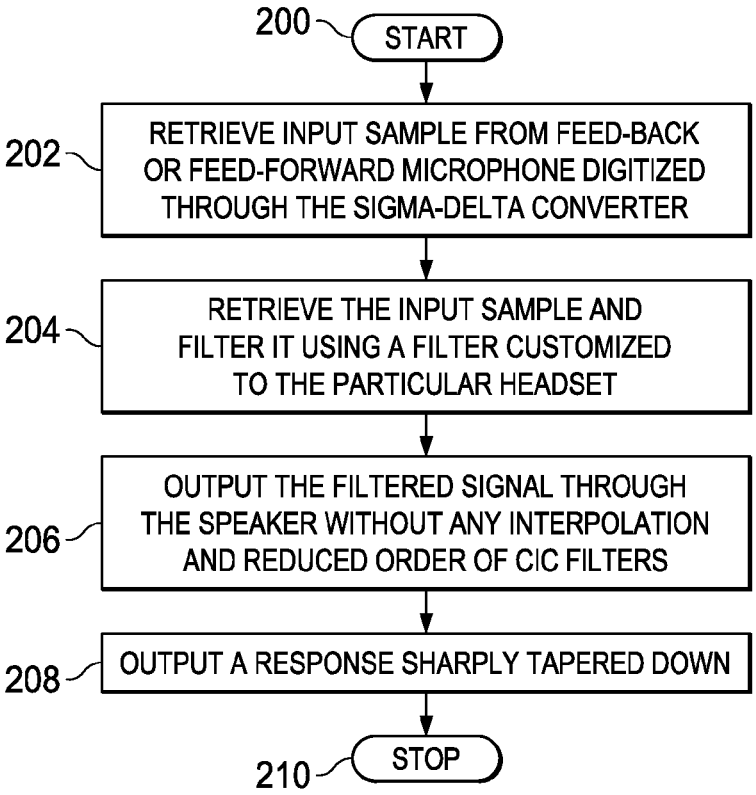
FIG. 2 is a flow diagram depicting a method for active noise canceling.

FIG. 2 is a flow diagram depicting a method for an active noise canceller using a fixed controller at oversampled data rates. The method starts at step 200 and proceeds to step 202. At step 202, the method 200 retrieves a digital input sample. The digitized input sample is from feedback or feedforward microphone and may be digitized through the sigma-delta converter. At step 204, the method 200 retrieves and filter the input sample, the filtering may be customized to the particular headset. The filter may be computed automatically or manually tuned for a target response. At step 206, the method 200 outputs the filtered signal without any interpolation and reduced order of CIC filters. At step 208, the method 200 outputs a response sharply tapered down. The method 200 ends at step 210.

For commercial headset active noise canceller solutions, a wideband implementation is necessary that may work with low-medium quality headset design. Oversampled data rates achieve both of these goals. The data may get sampled at 8-10 times the audio sample rate. These sample rates is much higher than the data rates used for audio applications.

As a result, active noise canceller may utilize hardware CIC filters for anti aliasing. A separate decimation component is avoided as the aliasing frequencies are close to 192 KHz. This is outside the range of hearing for humans. The decimation component also significantly contributes to the overall latency of the system. By not using a decimation filter the latency is minimized in the software processing. Also, oversampling allows for the use of hardware copy-paste filters for anti imaging, which avoids a separate interpolation component. Hence, the headphone and the microphone elements act as anti imaging/aliasing filters by filtering out higher frequencies, i.e. above 20 KHz.

Figure 3:
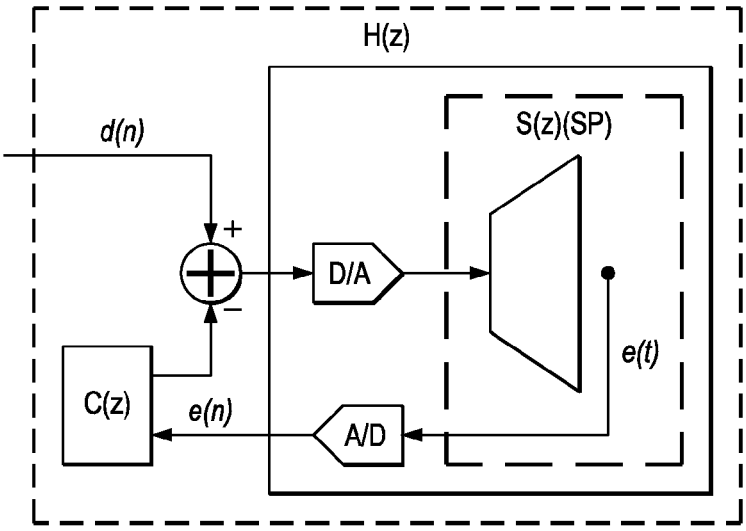
FIG. 3 is an embodiment depicting a controller.
Figure 4:
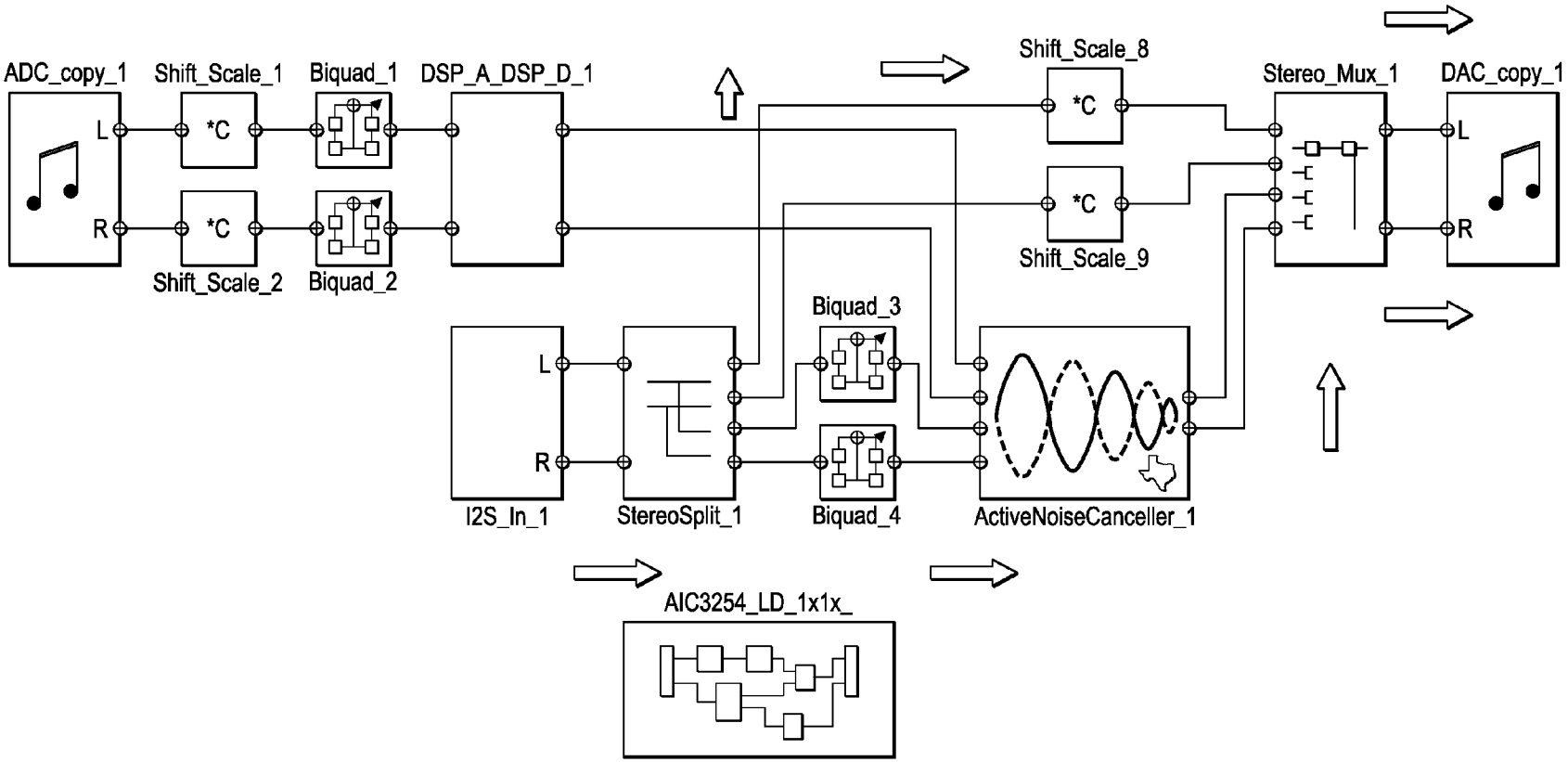
FIG. 4 is an embodiment depicting an alternate path for music equalization for non-active noise canceller.

In one embodiment, processing is performed at 384 KHz. At this sample rate we have an 8 sample delay in the ADC/DAC chain due to the CIC and the copy paste interpolation/decimation process. This corresponds to 20 us latency without using any filtering in the DSP. At these low delays, an analog-like controller design is implemented to perform noise cancellation. FIG. 3 is an embodiment depicting a controller. In this embodiment, the noise cancellation of interest is assumed to be below 1000 Hz. When data is oversampled, the delays are negligible for controller operation, which reduces the significance of such delays. As a result, a digital low pass filter may be used for noise cancellation. Since the latency of the filters increase with group delay, the lower order digital filters perform better noise cancellation. This structure has the bandwidth of the analog implementation along with advantages of digital solutions, which include low complexity solution, fixed music equalization, alternate path for music equalization for non-active noise canceller cases are possible, and tunable active noise canceller response. FIG. 4 is an embodiment depicting an alternate path for music equalization for non-active noise canceller. In FIG. 4, grey is the music path for active noise cancellation and black shows music path with active noise cancellation disabled Oversampled data rates allow for low latency in the feedback path giving good wideband performance for noise cancellation. A digital control provides easily tunable cancellation and music response as compared to analog systems and allows for separate ANC-on and ANC-off music paths. This allows for separate equalization for the headphones when the ANC is disabled. In an analog setup, additional data path is required for this feature making it expensive in terms of power and number of components.

As a result, a single solution is possible across a large selection of headphones. This lowers the overall silicon costs and provides them with a tunable equalizer for the headphone response. This solution offers the bandwidth of cancellation comparable to an analog solution with the tenability of a digital ANC.

Figure 5:
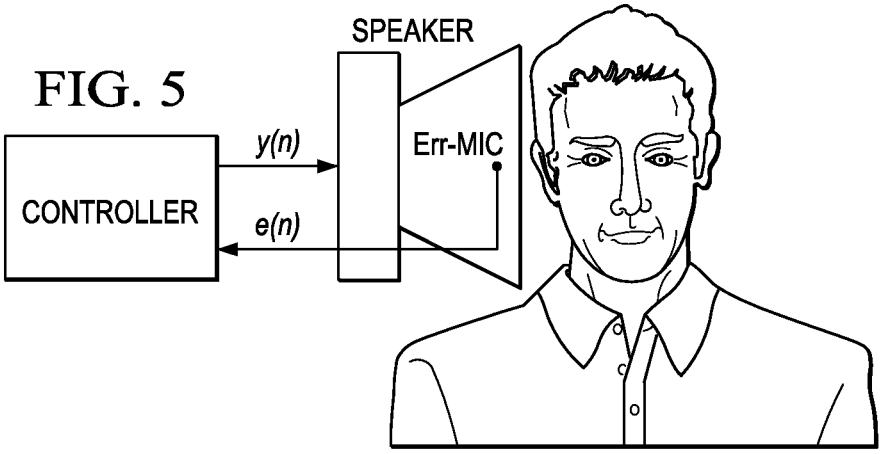
FIG. 5 is an embodiment depicting a feedback active noise cancellation for a headset.
Figure 6:
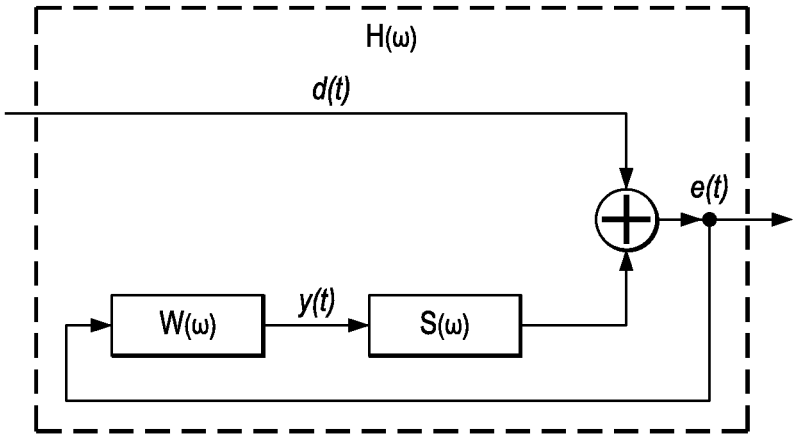
FIG. 6 is an alternate embodiment depicting a feedback active noise cancellation for a headset.

FIG. 5 is an embodiment depicting a feedback active noise cancellation for a headset. FIG. 6 is an alternate embodiment depicting a feedback active noise cancellation for a headset. The objective of the controller is to generate anti-noise y(n) to drive the error e(n) to zero. The controller can be fixed or adaptive. The stability of the system is a function of the headphone acoustics (i.e. secondary path) and the controller response.

Under steady state conditions $E(\omega)=D(\omega)-S(\omega)W(\omega)E(\omega) \rightarrow E(\omega)=D(\omega)/(1+S(\omega)W(\omega))$. If $S(\omega)$ were flat and without phase shift $E(\omega)$ could be made small by applying a large gain $W(\omega)$ over the frequencies of interest. In a digital system, $S(\omega)$ includes the delays caused by ND conversion filtering and D/A conversion and the headphone acoustics. As the delays in the SP become significant the controller becomes in-efficient and the bandwidth of cancellation reduces.

Figure 7:
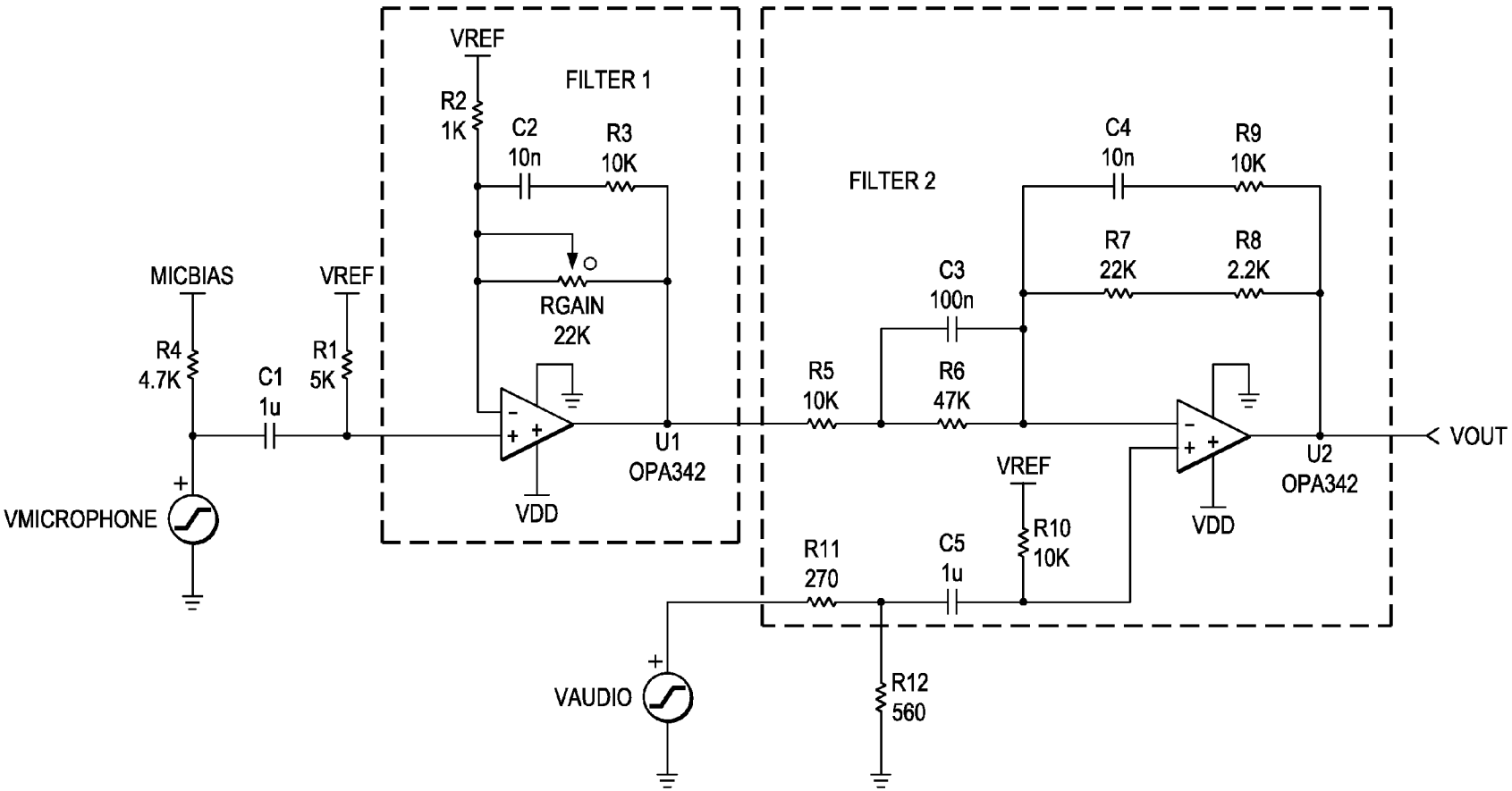
FIG. 7 (PRIOR ART)
FIG. 7 is an embodiment of an analog implementation of an active noise cancellation controller.
Figure 8:
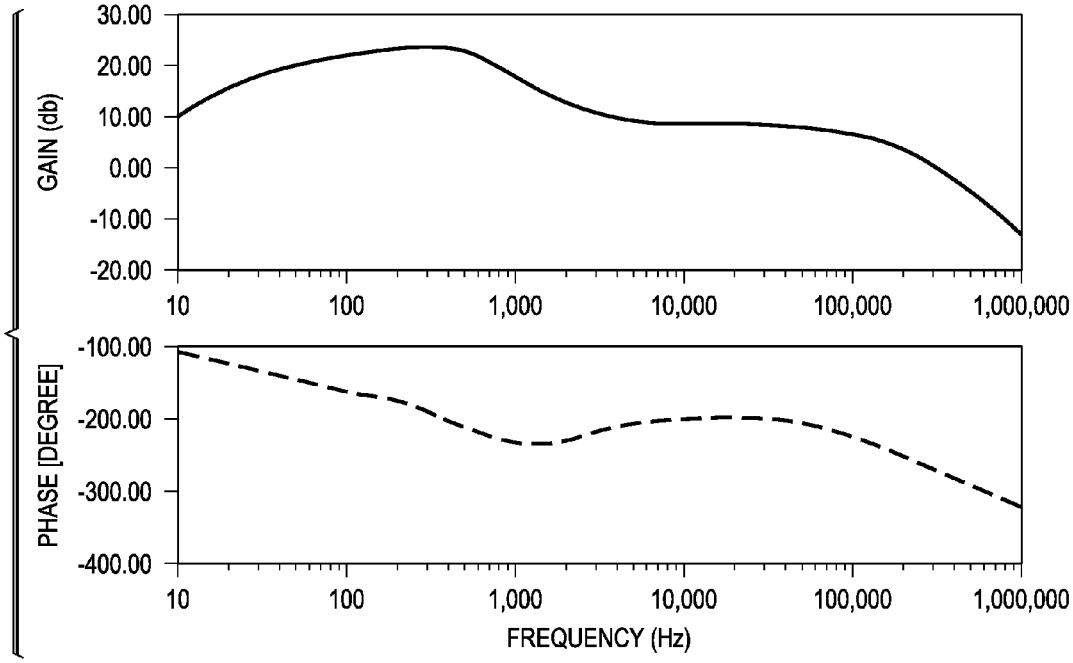
FIG. 8 (PRIOR ART)
FIG. 8 is an embodiment depicting an open loop response feedback of an analog active noise canceller.

FIG. 7 is an embodiment of an analog implementation of an active noise cancellation controller in accordance with the prior art. The noise path in the controller consists of a non-inverting amplifier (filter 1) followed by an inverting amplifier (filter 2). FIG. 8 is an embodiment depicting an open loop response feedback of an analog active noise canceller. Filter 2 also pre-equalizes the music to compensate for the attenuation cased by ANC.

Figure 9:
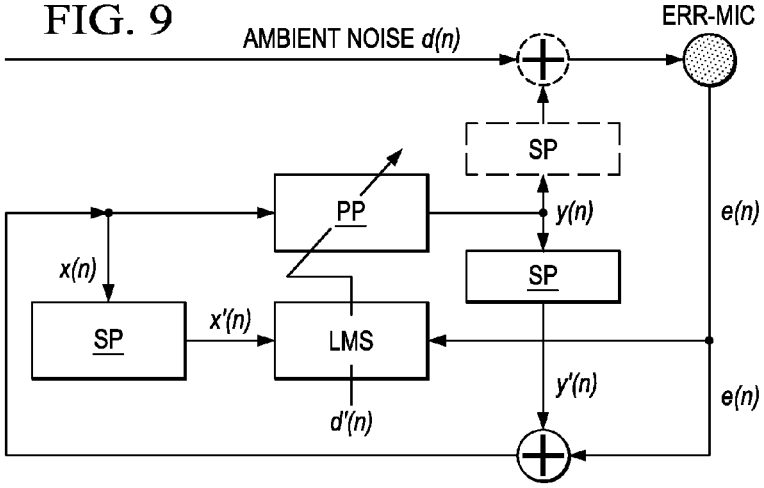
FIG. 9 is an embodiment depicting a wideband adaptive feedback digital active noise canceller with FXLMS.

The digital feedback active noise canceller is implemented using a Filtered-X-Ims algorithm. FIG. 9 is an embodiment depicting a wideband adaptive feedback digital active noise canceller with FXLMS. As described in FIG. 9, the FIR controller is adapted using the LMS algorithm to reduce the error e(n). The input to LMS is generated using e(n) and the secondary path estimate SP. This signal is filtered by SP to align the error with the estimated desired signal.

Table 1 describes a comparison of analogue and digital active noise canceller solution.

TABLE 1

| Analog ANC | Digital ANC |
|---|---|
| Secondary Path | |
| Low delay in secondary path | At audio frequencies the delays in secondary path and the controller is significant due to A/D→anti-alising→controller→D/A conversion |
| Bandwidth | |
| High Bandwidth of cancellation. Due to low delays high cancellation is possible by designing a controller with high gain in the frequency of interest | The signal chain delays significantly decrease the cancellation bandwidth |
| Controller design. | |
| Due to low delays in the SP, the design of a controller is a low pass filter. | The controller design needs to be adaptive/predictive to compensate for delays in the secondary path. This is computationally expensive |
| Secondary Path Variability | |
| Since the secondary path (controller path) is very fast, small movements in the headphone manifest as small changes in the secondary path and the controller still operates with good phase margins. | In the digital domain the changes in secondary path due to headphone movement become significant and the controller has to readapt to the changes [1]. This re-adaptation time is very long leading to poor cancellation performance. |
| Narrow Band Performance | |
| The analog controllers need extensive design for good narrowband cancellation. The controller design needs to accommodate for the phase lag in the secondary path for exact noise cancellation for narrow band noise. | Very good narrow band cancellation can be achieved as the phase lag in the secondary path can be compensated by adaptive filters. The variations in the secondary path are also easier to handle |
| Music Playback | |
| Since the controller is fixed, compensating for music playback is implemented as an equalizers to equalize for low frequency attenuations | Compensating for music is computationally due to the adaptive nature of the feedback path. The music is filtered using an inverse secondary |

TABLE 1-continued

| Analog ANC | Digital ANC |
|---|---|
| | path and controller filter to negate the attenuation caused by feedback. |

While the foregoing is directed to embodiments of the present invention, other and further embodiments of the invention may be devised without departing from the basic scope thereof, and the scope thereof is determined by the claims that follow.

What is claimed is:

1. A method of a digital processor for active noise cancelling and for minimizing ANC latency and processing path, comprising:

retrieving an input sample from at least one of a feedback or feedforward microphone digitized through a sigma-delta converter;

filtering with a related filter, wherein the filter is customized to a particular headset;

outputting a filtered signal through a speaker without any interpolation and reducing order of CIC filters, wherein the sigma-delta is configured to provide data at an oversampled domain with reduced order CIC and without any interpolation; and outputting a response sharply tapered down.

2. An active noise canceller configured to minimize ANC latency and processing path, comprising:

means for retrieving an input sample from at least one of a feedback or feedforward microphone digitized through a sigma-delta converter;

means for filtering with a related filter, wherein the filter is customized to a particular headset;

means for outputting a filtered signal through a speaker without any interpolation and means for reducing order of CIC filters, wherein the sigma-delta is configured to provide data at an oversampled domain with reduced order CIC and without any interpolation; and means for outputting a response sharply tapered down.

3. A non-transitory computer readable medium with executable computer instructions, when executed the instructions perform a method for active noise cancelling configured to minimize ANC latency and processing path, the method comprising:

retrieving an input sample from at least one of a feedback or feedforward microphone digitized through a sigma-delta converter;

filtering with a related filter, wherein the filter is customized to a particular headset;

outputting a filtered signal through a speaker without any interpolation and reducing order of CIC filters, wherein the sigma-delta is configured to provide data at an oversampled domain with reduced order CIC and without any interpolation; and outputting a response sharply tapered down.

* * * * *